United States Patent [19]

Quinlan, Jr. et al.

[11] Patent Number: 4,616,824

[45] Date of Patent: Oct. 14, 1986

[54] ELECTRIC SWING

[75] Inventors: Robert L. Quinlan, Jr., Barberton; Charles W. Lauro, Akron, both of Ohio

[73] Assignee: Gerber Products Company, Fremont, Mich.

[21] Appl. No.: 615,402

[22] Filed: May 29, 1984

[51] Int. Cl.[4] ..... A63G 9/16

[52] U.S. Cl. ..... 272/86; 5/108

[58] Field of Search ..... 272/86; 5/108, 109; 297/260, 330

[56] References Cited

U.S. PATENT DOCUMENTS

| | | | |
|---|---|---|---|
| 1,016,712 | 2/1912 | Schilling | 272/86 |
| 2,544,298 | 3/1951 | Chodacki et al. | 5/109 |
| 3,146,985 | 9/1964 | Grudoski | 272/86 X |
| 3,261,032 | 7/1966 | Reardon | 5/108 |
| 3,842,450 | 10/1974 | Pad | 5/109 |
| 4,491,317 | 1/1985 | Bansal | 272/86 |

FOREIGN PATENT DOCUMENTS

| | | | |
|---|---|---|---|
| 631026 | 10/1949 | United Kingdom | 272/86 |

*Primary Examiner*—Robert A. Hafer
*Assistant Examiner*—Arnold W. Kramer
*Attorney, Agent, or Firm*—Townsend and Townsend

[57] ABSTRACT

An electric swing mechanism includes a battery powered solenoid which exerts a motive force on a swinging infant seat. The solenoid is activated by the linear reciprocation of a specially designed actuator past a microswitch, so that the switch is closed and the solenoid activated in only one direction of the stroke. The mechanism's linkage system is designed to contact the swinging infant seat during only half of the seat's swinging cycle, and is mechanically isolated from the seat during the other half of its cycle.

1 Claim, 6 Drawing Figures

ELECTRIC SWING

FIELD OF THE INVENTION

This invention relates generally to infant seats and carriers, and specifically to an improved mechanism for reciprocating infant seats in a rocking motion.

BACKGROUND OF THE INVENTION

Infant seats and swings are well known. Numerous mechanical devices have been developed to reciprocally swing or "rock" infant seats, relieving the parent from manually doing so. Many of such devices rely on stored spring energy to provide the motive force, thereby requiring frequent windings of the spring. Obviously, an electrically powered system would be desirable, but there is an understandable, built-in reluctance on the part of many parents to place an infant in a swing wired to a conventional 110 volt AC wall socket. Accordingly, several electrically powered swings have been developed which utilize self-contained, low voltage DC batteries as their source of electrical power. Unfortunately, most of these prior art devices are expensive, unduly complex, inefficient or overly subject to wear.

SUMMARY OF THE INVENTION

An improved electric swing mechanism is provided in which a battery powered solenoid exerts a motive force on a swinging infant seat. The solenoid is activated by the linear (as opposed to arcuate) reciprocation of a specially designed actuator past a microswitch, so that the switch is closed and the solenoid activated in only one direction of the stroke. This linear alignment of the actuator and switch permits improved precision in the fabrication and construction of the mechanism thereby increasing reliability and efficiency in operation.

In addition, the mechanism's linkage system is designed to contact the swinging infant seat during only half of the seat's swinging cycle, and is mechanically isolated from the seat during the other half of its cycle. This isolation eliminates unnecessary frictional contact in the system, thereby reducing the power requirements and increasing battery life.

FIGS. *2a* through *2e* are a series of partially cutaway perspective views of the electric swing mechanism of this invention, illustrating the sequential movement of the component parts during a typical cycle of reciprocation of the swinging infant seat;

FIG. *2a* illustrates the mechanism in its quiescent position, not yet contacted by the swinging seat hanger, with the piston fully retracted into the solenoid;

FIG. *2b* illustrates the mechanism as it is first contacted and moved by the swinging seat hanger, raising the piston from the solenoid and bypassing the actuator past the switch;

FIG. *2c* illustrates the mechanism moved to its extreme position, at the end of the swinging seat hanger's pendulum arc, with the piston fully extended from the solenoid and the actuator having effectively bypassed the switch;

FIG. *2d* illustrates the mechanism during its return stroke, with the piston returning into the solenoid and the actuator just contacting the switch;

FIG. *2e* illustrates the mechanism in its return stroke, with the actuator fully contacting and closing the switch, thereby forceably drawing the piston the remaining distance into the solenoid and exerting a motive force on the swinging seat hanger.

DETAILED DESCRIPTION OF A PREFERRED EMBODIMENT

Figure 1:
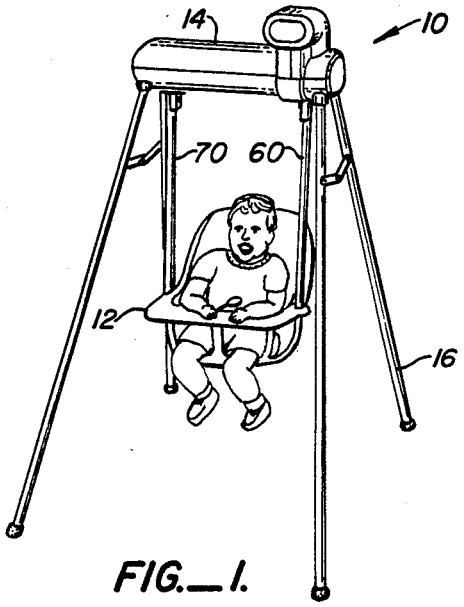
FIG. 1 is a perspective view of an infant's electric swing in operation.

Referring now to FIG. 1 with greater particularity, a perspective view of an infant's electric swing 10 is shown in use. The overall construction of such infant swings is well known, and typically includes an infant seat 12, swing hangers 60 and 70, support structure 14 and legs 16. The infant is secured into the seat, and the seat is manually set into a rocking motion by the parent. The mechanism for maintaining this rocking motion is contained within housing 18 on the support structure 14, and is set out in the following detailed description.

FIGS. *2a* through *2e* illustrate the operation of the electric swing mechanism that provides the necessary motive force to maintain the desired rocking action of the infant seat.

With particular reference to FIG. *2a*, mechanism 20 is shown contained within housing 18. Generally, mechanism 20 operates to exert a motive force upon swing hanger 60 which, as was illustrated in FIG. 1, is attached to the infant seat. Swing hanger 60 is movable about hanger axle 62 in a pendulum fashion, moving drive arm 56 and drive arm end 58 in an arc above the axle. In FIG. *2a*, drive arm 56 is disposed to one side of the axle, and is not in mechanical contact with the swing mechanism, but rather is freely swinging.

The component parts of swing mechanism 20 will now be described with reference to FIG. *2a*, with the operation of these components more fully described with reference to the subsequent figures.

Swing mechanism 20 includes L-shaped driver 50 having a free end 54 and connected end 52, pivotable about driver axle 53. End 52 pivotally connects to link 44 at link/driver axle 47. Link 44 is in turn pivotally connected to piston 26 at link/piston axle 45. Piston 26 is slidably engaged within solenoid 24, and in this rest position, contacts solenoid 24 with its piston stop 28 against cushion 30.

Figure 2A:
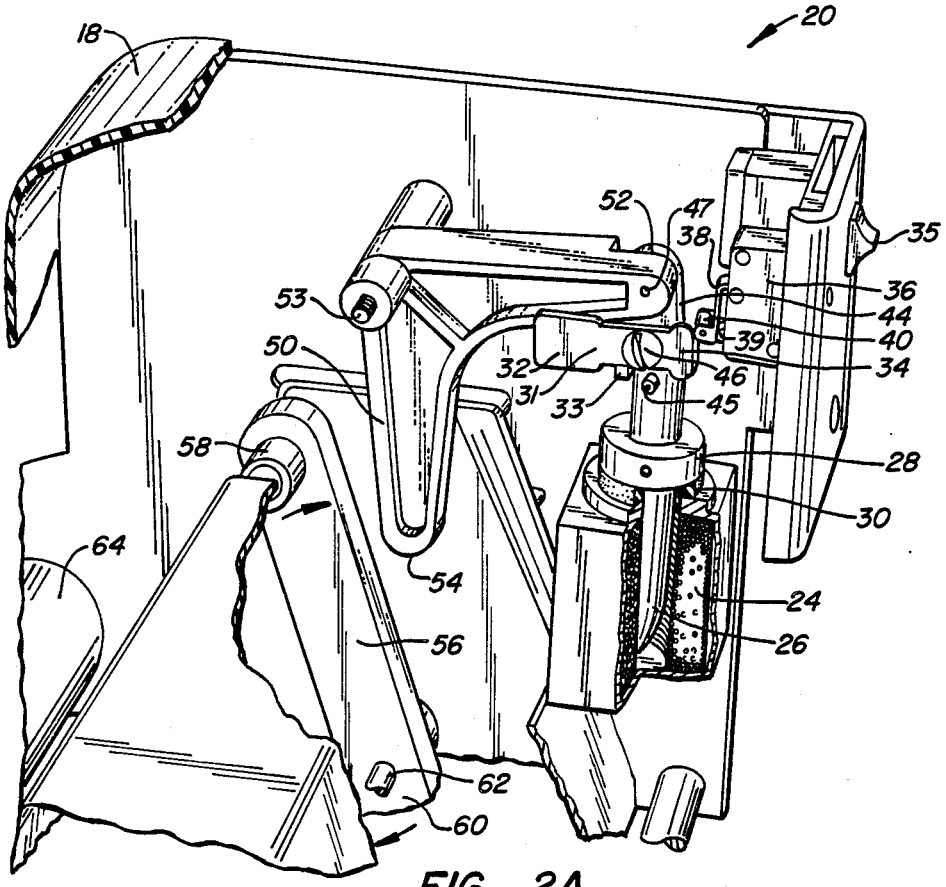
Figure 2B:
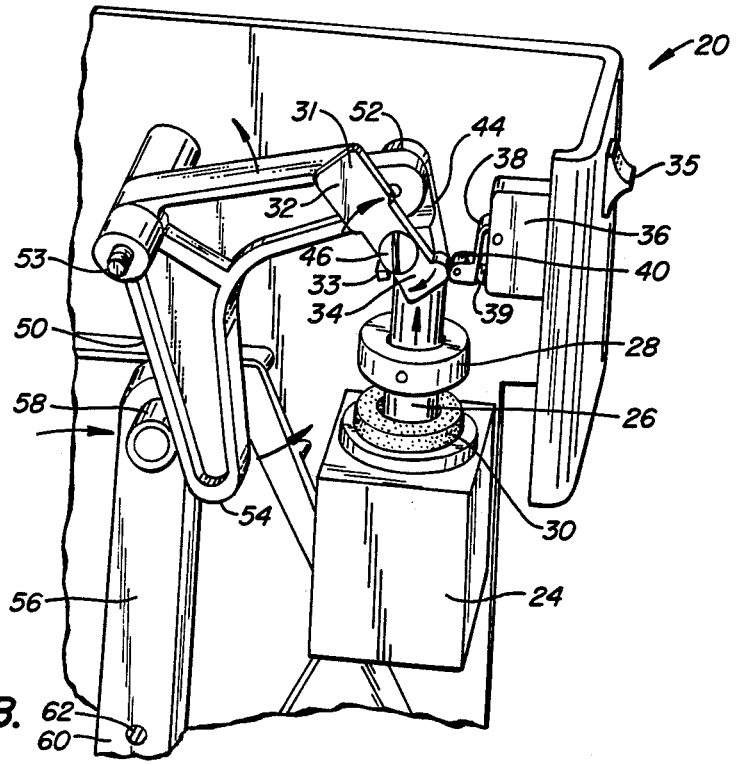

Solenoid 24 is powered by battery 64 via wires (not shown) connected through on-off control 35 to switch 36. Switch 36 is a standard microswitch, such as that manufactured by Micro Corporation, and includes switch arm 38, switch contact 39 and roller 40. It is designed to close the circuit and activate solenoid 24 only when engaged by actuator 31, which is itself pivotally mounted to link 44 at link/actuator axle 46. Actuator 31 is intentionally imbalanced by actuator weight 32, which is heavier than actuator head 34 on the other side of the fulcrum axle 46. In the view of FIG. 2A, weight 32 rests on actuator stop 33.

FIG. *2b* illustrates the system after swinging movement of the infant seat has caused drive arm end 58 to move and contact driver 50 at its free end 54, thereby moving it in the direction indicated by the arrow. Such movement causes an upward movement of link 44 and piston 26, through the above-described connections.

During such upward movement, the design of actuator 31 causes it to first contact switch roller 40, and then pivot clockwise about axle 46, to effectively bypass the switch without activating it.

Figure 2C:
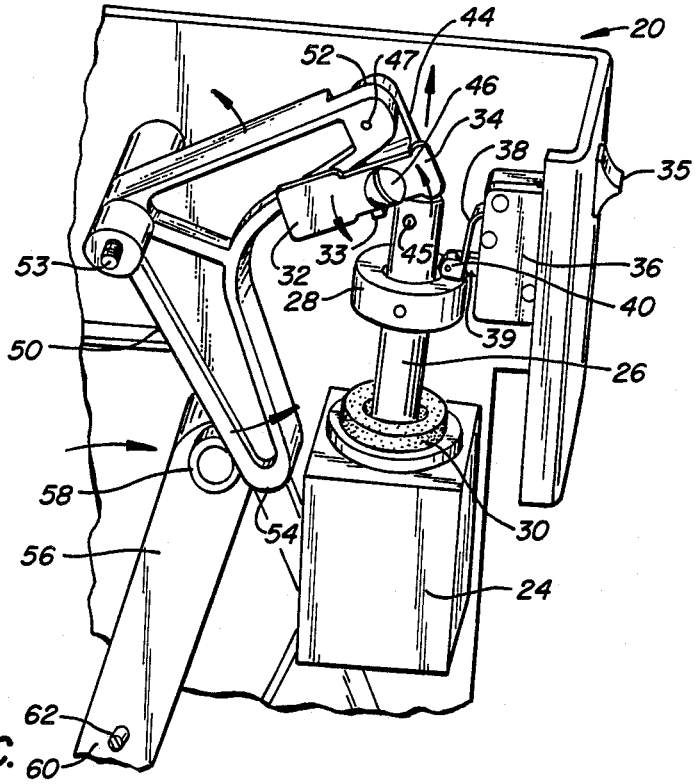

FIG. 2*c* further illustrates this effect by showing the mechanism at its extreme position, at the end of the swinging seat hanger's pendulum arc. Here, drive arm end 58 is fully moved to the right, causing driver 50, link 44 and piston 26 to move to their highest position. Having rotated to bypass switch 36 on the upward stroke, the slightly counterbalanced design of actuator 31 now causes it to move counterclockwise until actuator switch 32 falls to contact and rest upon actuator stop 33.

Figure 2D:
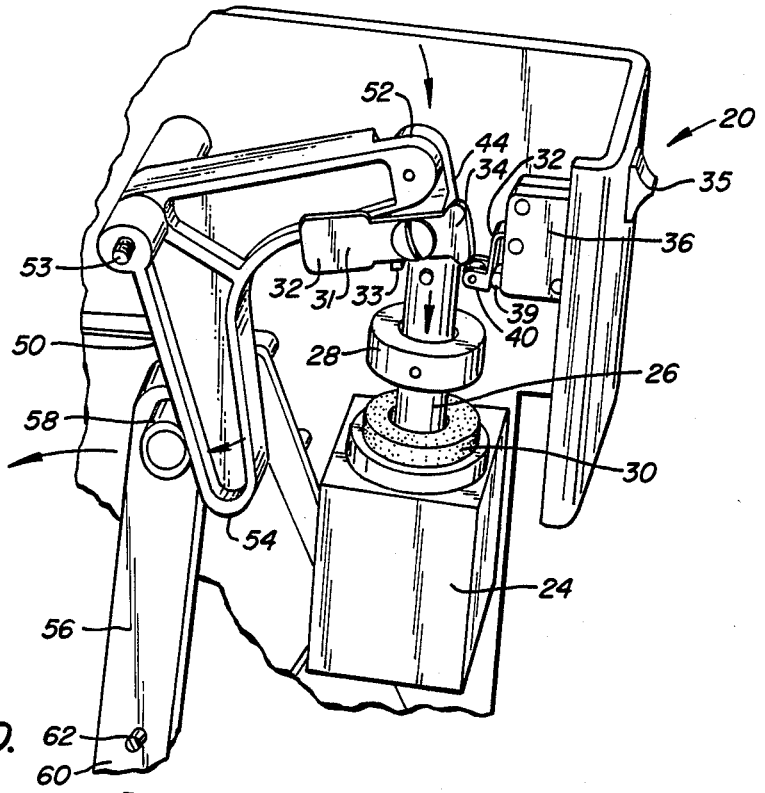

FIG. 2*d* shows the next sequence of positions, with the swing seat having begun its return movement, causing drive arm end 58 to move in the direction indicated. This permits piston 26, and its associated linkages, to begin its return stroke downward under the influence of gravity only, there being no direct mechanical connection to drive arm 56.

In this view, actuator 31 has just contacted switch roller 40 on this downward stroke, but has not moved the roller or engaged the switch. Note that up to and including this point in the sequence of events, no activation of the solenoid has taken place, and any and all movement of the system has been a result of the manually induced swinging of the infant seat, and its effect on the connections and linkages illustrated.

Figure 2E:
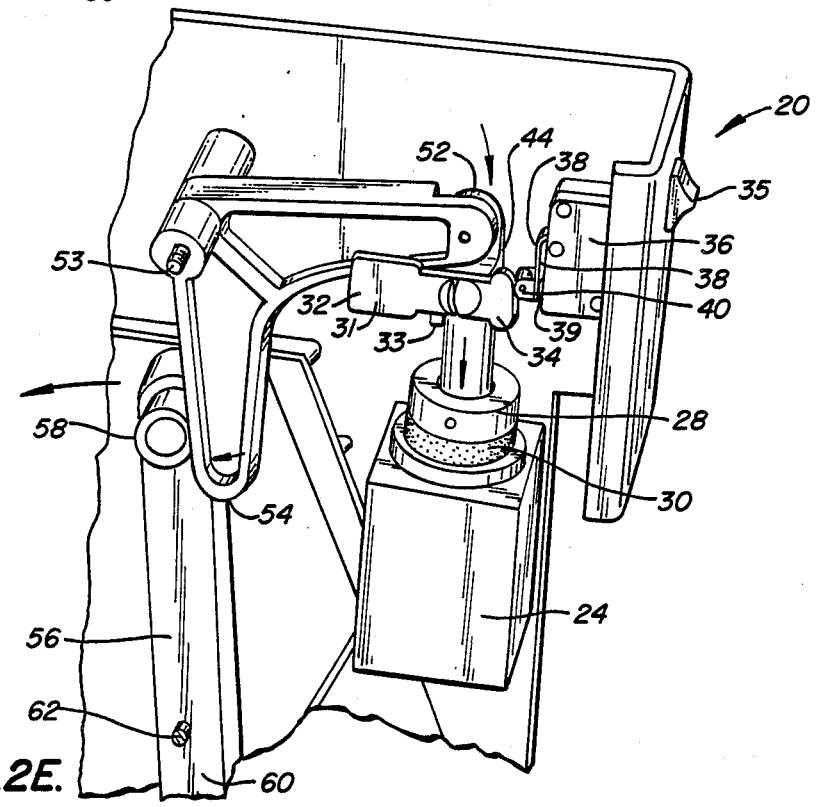

FIG. 2*e* illustrates the final and operative stage in the sequence. Here, drive arm end 58 has continued its movement away from the mechanism, as indicated by the arrows. This further movement enables piston 26 to continue its downward stroke, drawing actuator head 34 across switch roller 40. In this direction, however, actuator 31 is prevented from rotating by actuator stop 33. This causes actuator head 34 to depress switch roller 40 to contact with switch contact 39, effectively closing the switch and permitting electrical current to flow to solenoid 24.

The brief energization of solenoid 24 (typically on the order of 0.3 seconds), generates a magnetic field of sufficient strength to actively pull piston 26 the remaining distance into the solenoid. This motive force is transmitted through the connecting linkages to exert a brief but important "kick" to drive arm end 58, already moving in the direction described.

After this brief electrical connection, piston 26 will complete its downward stroke into solenoid 24, drawing actuator head 34 past roller 40, disengaging the electrical connection with switch contact 39. Piston 26 then stops its downward stroke when piston stop 28 contacts cushion 30. Cushion 30 is not required for the invention, but was included for suppression of noise which would otherwise be created by the impact of piston stop 28 with solenoid 24.

Having thus completed its downward stroke, piston 26 and its associated linkage remain in their quiescent position, as illustrated in FIG. 2*a* while the swing hanger and drive arm continue on the rest of their pendulum swing, unconnected to the swing mechanism. This feature of mechanical disconnection for fully one half of the swing cycle eliminates unnecessary frictional contact in the system, thereby reducing the power requirements and increasing battery life.

While this invention has been described in connection with preferred embodiments thereof, it is obvious that modifications and changes therein may be made by those skilled in the art to which it pertains without departing from the spirit and scope of this invention. Accordingly, the scope of this invention is to be limited only by the appended claims.

What is claimed as invention is:

1. An electric swing mechanism for exerting a swinging force on a swing hanger supporting a swing seat, comprising:

a low voltage direct current power source;

solenoid means mounted to the frame structure of the swing and linked to the power source for producing a motive force through a vertical piston when energized, the piston linearly reciprocating through the solenoid;

normally open switch means mounted to the frame for selectively energizing the solenoid when closed, said switch means further comprising a switch arm pivotally linked to engage a switch contact for closing said switch means, wherein said switch arm further comprises a roller;

link means having one end pivotally mounted to the top of said piston about an axis which is perpendicular to the central axis of the piston, said link means having an imbalanced actuator lever pivotally connected thereto, said imbalanced actuator lever pivoting in a pinned connection to the link means and, having an actuator head at one end with a curved edge surface shaped for closing the switch only in one direction of the stroke of the piston by causing the switch arm to abut against actuator stop means on said link means to engage the switch contact to close the switch on the downward stroke of the piston and causing the imbalanced lever to pivot and so rotate the roller along the curved surface edge of the actuator head of the lever without engaging the switch contact on the upward stroke of the piston; and linkage means for linking the swing hanger to the link means by transmitting the motive force to the swing hanger via intermittent physical contact between the linkage means and the swing hanger, wherein said linkage means further comprises a driver arm, shaped like an inverted L, having one end pivotally linked to the other end of the link means, the other end free to intermittently contact the swing hanger with a pushing force, and the apex of said driver arm pivotally pinned to a frame structure for the swing.

* * * * *